US005590909A

United States Patent [19]

Urban et al.

[11] Patent Number: 5,590,909

[45] Date of Patent: Jan. 7, 1997

[54] FILE COVER RESTRAINING DEVICE

[75] Inventors: Joseph Urban, Mountain View, Calif.; Richard Roig, Paterson, N.J.; Fikre Ayele, 1680 York Ave. #3G, New York, N.Y. 10128

[73] Assignee: Fikre Ayele, New York, N.Y.

[21] Appl. No.: 422,010

[22] Filed: Apr. 6, 1995

Related U.S. Application Data

[63] Continuation-in-part of Ser. No. 344,289, Nov. 23, 1994, abandoned.

[51] Int. Cl.[6] ..... B42D 1/00

[52] U.S. Cl. ..... 281/20; 281/29; 281/37; 402/80 R

[58] Field of Search ..... 281/20, 15.1, 18, 281/29, 37, 51, 21.1, 28; 402/70, 73, 80 R, 4, 76, 502

[56] References Cited

U.S. PATENT DOCUMENTS

| | | | |
|---|---|---|---|
| 501,751 | 7/1893 | Waring . | |
| 717,842 | 1/1903 | Grimes . | |
| 1,890,139 | 12/1932 | Auburn | 281/37 X |
| 2,323,285 | 6/1943 | Trussel . | |
| 3,074,744 | 1/1963 | Pucci et al. | 281/37 |
| 4,453,850 | 6/1984 | Purcocks | 402/70 X |
| 4,524,991 | 6/1985 | Thomas | 281/20 |
| 4,531,764 | 7/1985 | Chang | 402/80 R |
| 4,569,613 | 11/1986 | Thomas | 402/80 R |
| 4,744,689 | 5/1988 | Sternberg | 402/502 X |
| 4,828,421 | 5/1989 | Arakaki | 402/80 R X |
| 4,932,679 | 6/1990 | Mayer et al. | 281/18 |
| 4,997,207 | 3/1991 | Feldman | 402/502 X |
| 5,002,416 | 3/1991 | Serzen | 402/74 |
| 5,067,748 | 11/1991 | Wernquest | 402/73 X |
| 5,069,567 | 12/1991 | Fink et al. | 402/73 X |
| 5,108,130 | 4/1992 | Hansen | 281/18 |
| 5,110,232 | 5/1992 | Jermann | 402/8 |
| 5,209,593 | 5/1993 | Ros | 281/15.1 X |
| 5,267,804 | 12/1993 | Baumgarten | 402/80 R |

FOREIGN PATENT DOCUMENTS

| | | | |
|---|---|---|---|
| 2513942 | 4/1983 | France | 281/18 |
| 9002226 | 6/1983 | Germany | 402/502 |

*Primary Examiner*—Frances Han
*Attorney, Agent, or Firm*—Robert W. J. Usher

[57] ABSTRACT

A file cover restraining device includes a strut-like restraining member for bridging the inside surfaces of the file cover members and constructed from first and second elongate strut members interconnected for relative longitudinal sliding movement thereby to adjust a length of the restraining member to match the separation of the cover members and retained in a selected position by manually operable latches. The first strut member has a hook on an end thereof remote from the second strut member, a first cover mounting portion being pivotally connected to an end of the second strut member remote from the first strut member and having adhesive for attachment to an inside surface of one cover member and, a second cover mounting portion has adhesive for attachment to an inside surface of the other cover member and is formed with an eye. The hook and eye are releasably engaged by pivotal movement of the restraining member toward the spine.

15 Claims, 3 Drawing Sheets

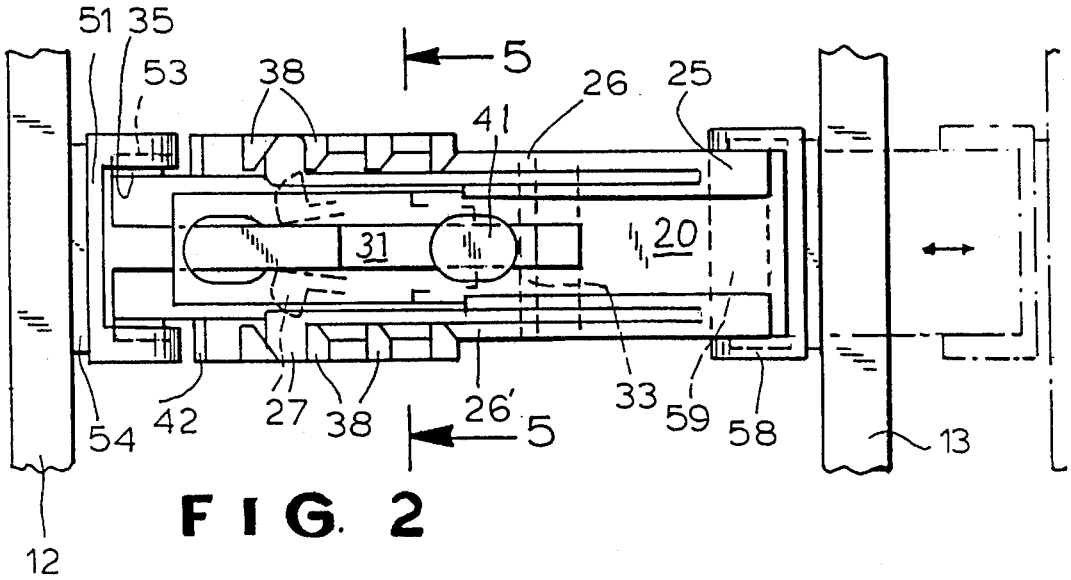
FIG. 2
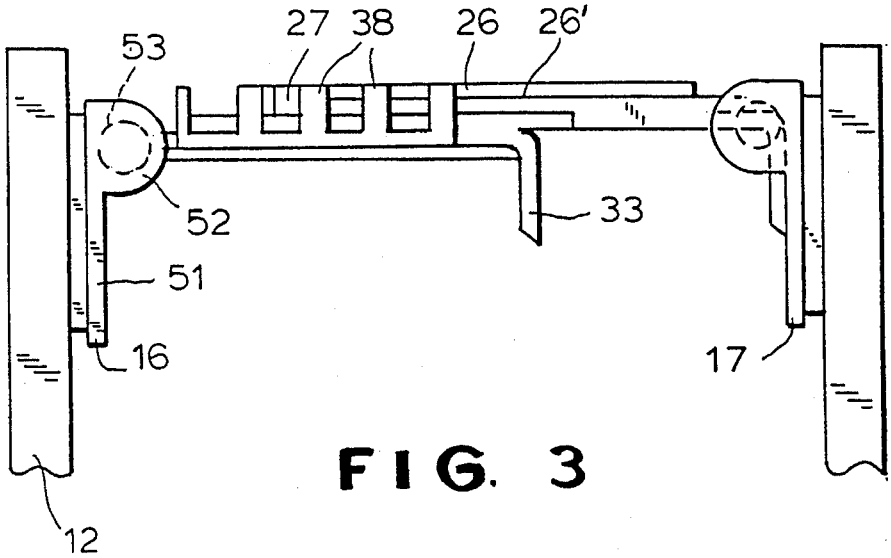
FIG. 3
FIG. 4
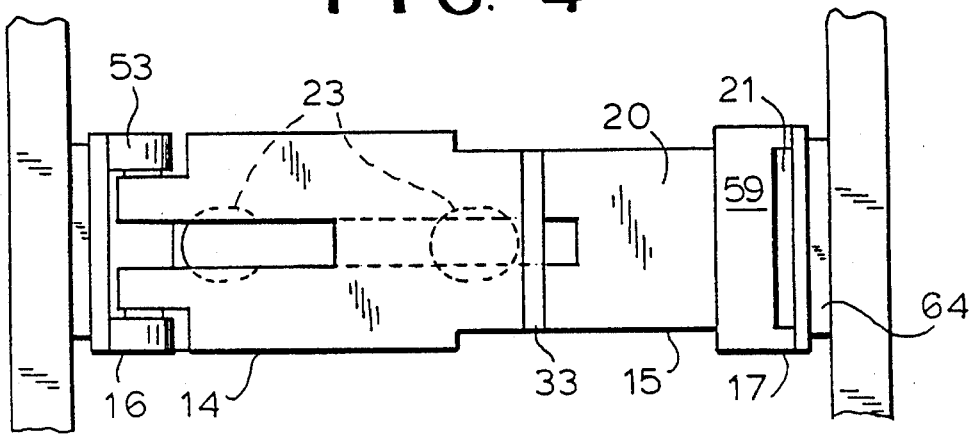

FILE COVER RESTRAINING DEVICE

This application is a continuation-in-part of Ser. No. 08/344,289, filed on Nov. 23, 1994, which is now abandoned.

FIELD OF THE INVENTION

The invention relates to a file cover restraining device for maintaining the cover members of a loose leaf binder spaced apart in parallel relation.

BACKGROUND OF THE INVENTION

The problems associated with maintaining the cover members of a loose leaf binder spaced apart in parallel relation are well recognized and there have been many prior attempts over many years to provide a satisfactory solution.

For example, U.S. Pat. No. 4,531,764 issued to Chang in 1985 teaches mounting an adjustable closed loop strip inside a cover to provide a spacer. However, the strip must be adjusted with any significant change in the number of papers in the file which procedure can be inconvenient and time consuming. Furthermore, the strip does not provide a closure member for the file.

In another approach, taught by U.S. Pat. No. 4,744,689, issued to Sternberg in 1988, a spacing block is mounted permanently along a free edge of one cover and hook and eye fasteners releasably secure the other cover to the top of the block. A block mounting process would seem to involve an undesirably time consuming manufacturing process and the presence of block may add significantly to the weight of the binder. Additionally, hook and loop fasteners can, in practice, be relatively difficult and time consuming to open.

In other approaches, taught by U.S. Pat. Nos. 4,569,613 and 4,524,991, issued to Thomas in 1984 and 1983, respectively, a channel section restraining member has clips releasably receiving the entire free edges of the covers along the open side remote from the spine. However, the restraining member must be completely removed from the file each time to open the file to add papers while it can be relatively difficult to align both the entire free edges with the respective clips for forcible receipt therein, particularly if the file is relatively worn and the hinged connection to the spine is weak so that the covers are not precisely aligned with each other or, if the file is slightly overfull, requiring the cover members to be manually forced together. Furthermore, the clips protrude outside the covers requiring additional shelf space and possibly causing obstruction.

In an attempt to overcome at least some of the disadvantages of the above-mentioned teachings listed therein, U.S. Pat. No. 4,997,207 issued to Feldman in 1992 specifically directs that any such restraining member be permanently attached to a notebook cover. However, the binder relies on a particular construction of detent latching mechanism which requires that the restraining member be depressed into the file along the entire length thereof to fasten and release the latching mechanism which can require difficult manipulation particularly as some papers may be improperly filed obstructing the inner movement of the restraining member or when the file is slightly overfull. In addition, there would appear to be a risk of the hinge portion weakening in resiliency in use of the binder for an extended period.

In other approaches teaching permanent attachment of spacing members, U.S. Pat. No. 5,002,416 issued to Serzen in 1991, teaches post-form spacing portions which can be broken to required height and are preferably attached by adhesive to upstand from the inside surface of one cover member but do not secure the binder in closed condition; 501,751 issued to Waring in 1893 teaches loop-form restraining members located to upstand around the entire periphery of the file opening while 717,842 to Grimes teaches a height adjustable post screw mounted into a cover member requiring an undesirably massive construction, complex and expensive manufacture and relatively time consuming to assemble. The upstanding spacing or restraining members taught by Serzen and Grimes may also impede access to file papers during file use, while the ring catch taught by Grimes may prove relatively difficult to manipulate.

Still Other approaches are described in U.S. Pat. No. 5,267,804 filed September 1991 and issued December 1993 to Baumgarten; U.S. Pat. No. 5,069,567 to Fink et al; French 252942 published 1983; German 9002226 published 1983; 5067748 issued 1991 to Wernques; U.S. Pat. No. 4,932,679 issued 1990 to Mayer.

U.S. Pat. No. 2,323,285 issued in 1943 to Trussel teaches the use of keyhole shaped slots in a spine mechanism for releasable retaining resiliently flexible binding rings or loops.

SUMMARY OF THE INVENTION

An object of the invention is to provide a file cover restraining device which the cover members are maintained spaced apart in parallel relation, even when the file is only partly filled and yet which can easily be opened and closed.

Another object of the invention is to provide a file cover restraining system including a restraining member for maintaining the cover members spaced apart in parallel relation that can be assembled (or retrofitted manually with a conventional file of any size (within limits), only when required, and without a requirement for any tools, by attachment by adhesion to respective cover members quickly and easily without modification to the file being required.

A further object of the invention is to provide a file cover restraining device which does not require any additional shelf space when is assembled with the file and which, in particular, does not protrude outside the cover members so that obstruction to insertion and removal from between adjacent files and risk of damage thereto is obviated.

An additional object of the invention is to provide a file cover restraining device which is reasonably economical to manufacture.

According to one aspect, the invention provides a file cover restraining device for a loose leaf binder of the type having a pair of substantially rigid cover members hingedly joined to respective opposite, parallel, longitudinal edges of a substantially rigid spine for receiving between them stacked papers and comprising a restraining member for maintaining the cover members closed spaced apart in parallel relation comprising first and second elongate strut members interengagable for relative longitudinal sliding movement thereby to adjust a length of the restraining member to substantially match a separation of the cover members to a width of the spine and manually operable, detent latching means on the strut members for latching the strut members in a selected position of adjustment, the first strut member having a first catch means on an end thereof remote from the second strut member, a first cover mounting portion pivotally connected to an end of the second strut member remote from the first strut member for attachment by adhesion to an inside surface of one cover member and, a second catch means releasably engagable with the first catch means and having a second cover mounting portion for attachment by adhesion to an inside surface of another cover member; so that, when the respective mounting portions are adhesively mounted on respective cover members adjacent respective free edges thereof remote from the spine, the first and the second strut members can be manually interengaged and slid relatively together to adjust a length of the restraining member to match a separation of the cover members to a width of the spine and the first and second catch means brought into releasable engagement by pivotal movement of the restraining member, so that the restraining member bridges the inside surfaces of the cover members retaining them in closed condition spaced apart in parallel relation.

Thus, the restraining device can be easily and quickly retrofitted by hand, without the need for tools, to files of all sizes and remains completely within the file obviating requirement for increased space or external obstruction and will occupy only a minimum of file space adjacent the file opening obviating or minimizing any interference with the papers therein.

Preferably, the first and second catch means comprise complementary hook form tongue and eye members on the strut member and second cover mounting portion, respectively and which are engaged and released by inward and outward pivotal movement of the restraining member, respectively, towards and away from the spine, respectively. Thus, the file carrying the restraining device may be easily opened and closed.

Desirably, the detent latching means comprises a series of latching teeth integrally formed with one of the strut members to extend at predetermined spaced apart intervals therealong and resiliently flexible latching arm means integrally formed with another of the strut members and having a latching head biassed by the latching arm means to snap into engagement between selected teeth during relative longitudinal sliding movement of the strut members together thereby to latch the first and the second strut members in a selected position of adjustment. This is a simple structure which is easily adjusted manually.

The latching arm means is resiliently flexible in a plane substantially parallel to the spine faciliating adjustment without interference with the file papers.

It is further preferred that the detent latching means comprises two series of latching teeth integrally formed with one strut member to extend at predetermined spaced apart intervals along respective opposite longitudinal edges thereof and two resiliently flexible latching arm means integrally formed with another strut member for flexure in a plane substantially parallel to the spine and integrally formed with respective latching heads biassed by the latching arm means to snap into engagement between selected teeth during relative longitudinal sliding movement of the strut members together thereby to latch the first and the second strut members in a selected position of adjustment. This provides a balanced adjustment which may be incorporated in a single part which can be molded for simplicity an economy of mass production.

In a desired construction, one of the first and the second strut members is integrally formed with an undercut stud and another of the first and the second strut members is formed with a longitudinally extending keyhole slot which can receive the stud thereby to maintain the first and the second strut members interengage for said relative longitudinal sliding movement.

Another hook form tongue member may depend from an end of the first strut member remote from the cover mounting means for engagement with said eye when the first strut member is disengaged from said second strut member for use with a binder having a spine of small width which is less than a minimum adjusted length of the retaining member.

Preferably, said end of said second strut member remote from the first strut member is bifurcated providing a pair of stiffly resilient mounting arms extending side by side in parallel relation and having free ends formed witch respective trunnion mounting portions, and the first cover mounting portion comprises a pair of sockets for pivotally receiving respective trunnion mounting portions in pivotal engagement whereby the second strut member is pivotally connected to the second strut member. this enables the first strut member and the mounting member to be formed as separate parts as by an economical molding technique and yet quickly and reliably assembled.

Advantageously, latching teeth have inwardly directed portions which hook over respective latching arms thereby maintaining the first and the second strut in sliding engagement affording additional stability both during and subseqent to adjustment.

BRIEF DESCRIPTION OF THE DRAWINGS

A specific embodiment of the invention wil now be described by way of example only and with reference to the accompanying drawings in which:

FIG. 2 is a plan view of the restraining device mounted on cover members of a binder;

FIG. 3 is a side elevation of the restraining device mounted on cover members of a binder;

FIG. 4 is an underplan view of the restraining device mounted on cover members of a binder;

PARTICULAR DESCRIPTION

Figure 1:
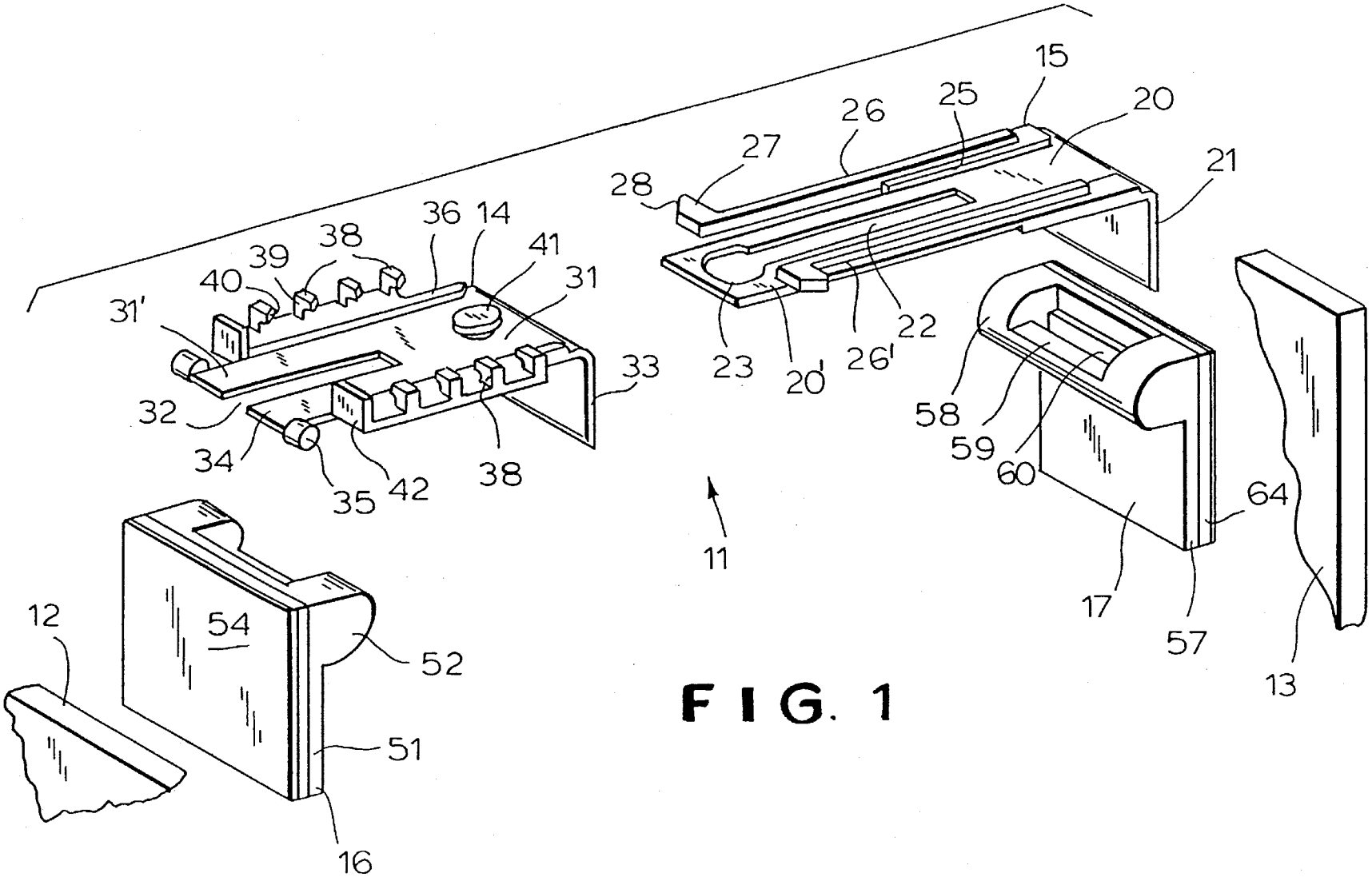
FIG. 1 is an exploded perspective view of a restraining device according to the invention.

As best seen in FIG. 1, the file cover restraining device comprises a restraining member 11, adjustable in length for maintaining the cover members 12,13 closed spaced apart in parallel relation, and including first and second, elongate strut members 14 and 15, respectively, and first and second cover mounting portions 16 and 17, respectively, for attachment by adhesive inside surfaces of respective cover members 12 and 13.

The second strut member 15 is molded in one piece from suitable plastic material and is formed with a rigid, elongate plate portion 20 having an elongate forward portion 20' of reduced width, a catch formed by a tab-like hook 21 depending from a rear end thereof and a keyhole retention slot 22 extending along the forward portion 20' and having an enlarged entry end 23 adjacent the end thereof. A pair of mounting portions 25 upstand longitudinally on respective opposite lateral edge portions adjacent the rear end and carry respective resilient, forwardly extending, latching arms 26 which have a laterally outward directed L section or step providing a longitudinal retention ledge 26' adjacent, and extend outside respective outer lateral edges of the forward portion 20' and which have outward extending latching heads with camming noses 27 on forward free ends 28 thereof.

The first strut member 14 is molded in one piece from suitable plastic material and is formed with a rigid, elongate plate portion 31 having an elongate, bifurcated forward portion 31', a catch formed by a tab-like hook 33 depending from a rear end thereof. The bifurcation is formed by a slot 32 extending along the forward portion 31' and opening to the end, thereby providing a pair of longitudinally extending, stiffly resilient mounting arms 34 which have free ends carrying respective mounting trunnions 35. A pair of supporting walls 36 upstand longitudinally and protrude laterally outward of respective opposite lateral edge portions adjacent the rear end, defining a channel section and carry respective rows of longitudinally spaced latching teeth 38 formed with inward extending arm trapping hook portions 39 with respective rearward facing camming surfaces 40. Abutment flanges 42 upstand from respective supporting walls 36 spaced apart from, and aligned opposite the respective trunnions.

The first cover mounting member 16 is molded in one piece from suitable plastic material and comprises a substantially square mounting plate portion 51 formed with mounting ears 52 protruding forward from respective opposite upper corners thereof and formed with respective inward opening mounting sockets 53. A strip of double-side adhesive tape 54 is attached to a rear mounting surface 57 of the plate portion.

The second cover mounting member 17 is also molded in one piece from suitable plastic material and comprises a substantially square mounting plate portion 57 formed with mounting ears 58 protruding forward from respective opposite upper corners thereof and joined by a transverse bar 59 formed with a tranverse slot 60, providing a catch. A strip of double-side adhesive tape 64 is attached to a rear mounting surface 54 of the plate portion.

The restraining device is normally supplied as a partly assembled kit with the second strut member 14 pivotally connected to the first cover mounting member 16 by manually squeezing together respective limbs 34 and inserting the respective trunnions 35 into respective sockets 53 where they are retained by the resiling action of the limbs 34. The respective protective layers are then removed from the respective strips of adhesive tape 54, 64 and respective cover mounting members 16,17 adhered to respective cover members at locations adjacent free ends thereof. The second strut member 15 is then manually assembled with the first strut member 14 by receipt of the stud 41 of the first strut member 14 in the entry opening 23 of the keyhole slot 22 in the second strut member with receipt of the forward end portion 20' of the plate portion 20 of the second strut member in the channel section of the first strut member, and the second strut member slid forwards while gently squeezing the resilient arms 26 together until the respective latching heads 27 are cammed inwards by engagement between the camming surfaces 40 and 28 on the teeth 38 and latching heads 27, respectively, and snap back into latching engagement between selected respective adjacent teeth 38 of the two rows, which traps the ledges 26' thereof under respective hooked portions 39 of the teeth 38.

Figure 5:
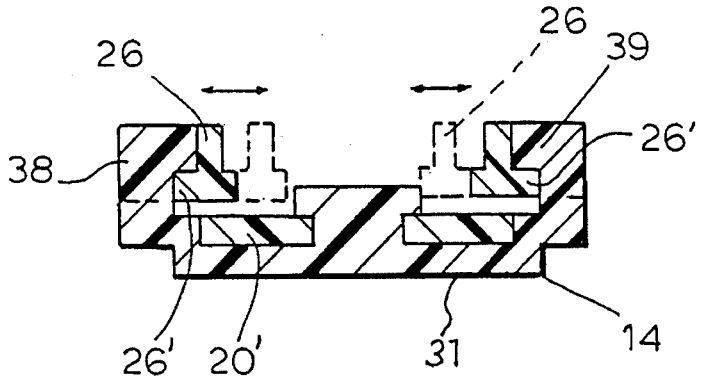
FIG. 5 is a cross-sectional view taken along lines 5—5 of FIG. 2.

Pivotal movement of the restraining member toward the binder spine permits the hook 21 to enter the slot 60 so that the restraining member bridges the cover members to maintain the cover members a selected distance apart. Any necessary adjustments to the length of the restraining member to ensure a parallel condition of the cover members can be effected simply by initially manually squeezing the latch arms together until the respective cam surfaces are aligned and sliding the strut members further together causing the latch members to be cammed inwards (to the position indicated in broken lines in FIGS. 2 and 5) and ride over the adjacent teeth in the squeezing direction and snap between the next pair of adjacent teeth to narrow the bridge, such manual squeezing action being necessary to withdraw the latching heads from between adjacent teeth if expansion of the restraining member is desired. Different positions of the entry portion of the slot member which corresponding to different extensions of the restraining member are indicated by broken lines in FIG. 4

Figure 6:
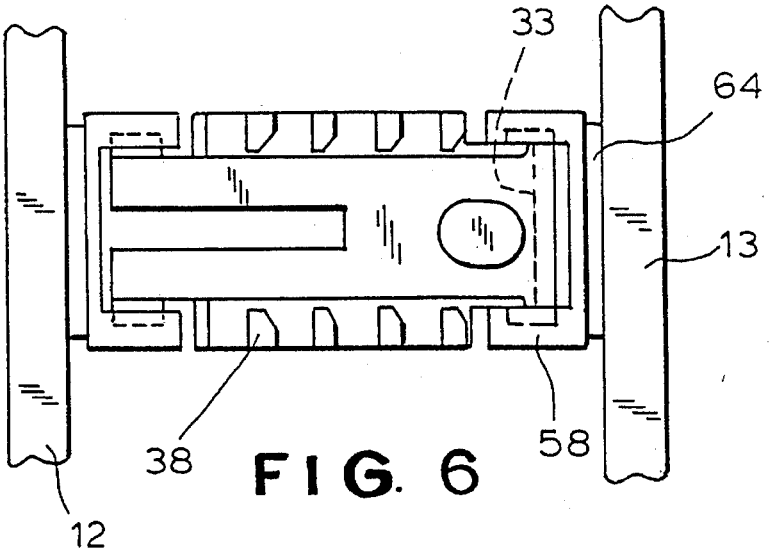
FIG. 6 is a plan view of the restraining device utilising only a first strut member and mounted on cover members of a binder; and, FIG. 7 is a side elevation of the restraining device utilising only a first strut member and mounted on cover members of a binder.
Figure 7:
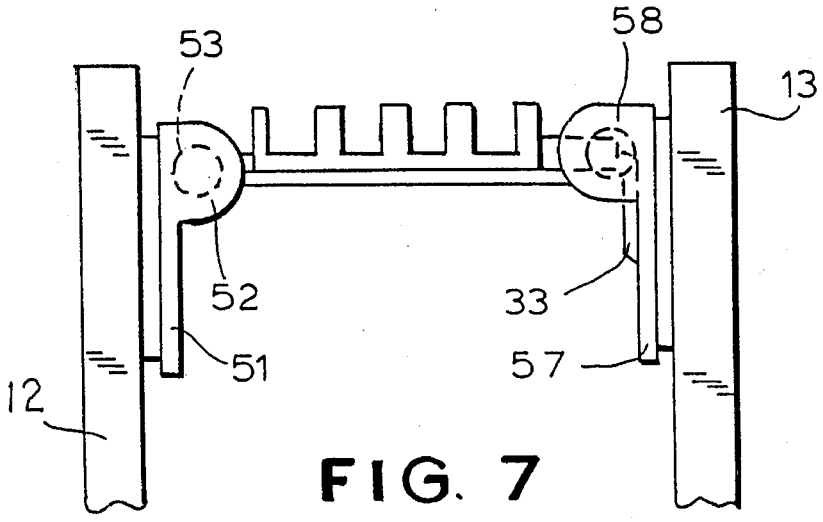

As shown in FIGS. 6 and 7, when the width of the binder is less than the minimum combined length of the strut members, the second strut member can be omitted and the hook 33 can be received in the slot 60 to secure the cover members together.

In a modification, (not shown) upstanding fingerpieces may be formed on respective latching arms and a stop means may be provided on the cover mounting member 16 or on the first strut member to prevent the strut member pivoting inward toward the spine beyond a position perpendicular to the cover members.

Arms 34 of the first strut member can be sufficiently flexible to enable them to be manually squezed together to remove the trunnions from the sockets 53 wthout need for a tool, when the strut member is not required.

Apertures can be provided in the mounting plates of the mounting members for receiving rivets instead of, or in addition to, the use of adhesive to attach the mounting members to the cover members, the cover material itself often being of plastic which is sufficiently soft or weak for penetration by a manually operated riveting tool.

An additional possibility is the use of pressure sensitive hook and loop pile material such as VELCRO (TRADEMARK) secured to the file cover members and mounting plates respectively to secure the mounting members to the cover members.

We claim:

1. A file cover restraining device for a loose leaf binder of the type having a pair of substantially rigid cover members hingedly joined to respective opposite, parallel, longitudinal edges of a substantially rigid spine for receiving between them stacked papers and comprising a restraining member for maintaining the cover members closed spaced apart in parallel relation comprising first and second elongate strut members interengagable for relative longitudinal sliding movement thereby to adjust a length of the restraining member to substantially match a separation of the cover members to a width of the spine and manually operable, detent latching means on the strut members for latching the strut members in a selected position of adjustment, the first strut member having a first catch means on an end thereof remote from the second strut member, a first cover mounting portion pivotally connected to an end of the second strut member remote from the first strut member and having means for attachment to an inside surface of one cover member and, a second catch means releasably engagable with the first catch means and having a second cover mounting portion with means for attachment to an inside surface of another cover member; so that, when the respective mounting portions are attached to respective cover members adjacent respective free edges thereof remote from the spine, the first and the second strut members can be manually interengaged and slid relatively together to adjust a length of the restraining member to match a separation of the cover members to a width of the spine and the first and second catch means brought into releasable engagement by pivotal movement of the restraining member, so that the restraining member bridges the inside surfaces of the cover members retaining them in closed condition spaced apart in parallel relation.

2. A device according to claim 1, wherein the first and second catch means comprise complementary hook form tongue and eye members engaged and released by inward and outward pivotal movement of the restraining member, respectively, towards and away from the spine, respectively.

3. A device according to claim 2, wherein the hook form tongue and eye members are on the strut member and second cover mounting portion, respectively.

4. A device according to claim 3, wherein the means for attachment each comprises a contact adhesive on respective cover mounting portions.

5. A device according to claim 3, wherein another hook form tongue member depends from an end of the first strut member remote from the cover mounting means and is engageable with said eye when the first strut member is disengaged from said second strut member for use with a binder having a spine of small width which is less than a minimum adjusted length of the retaining member.

6. A device according to claim 1, wherein the detent latching means comprises a series of latching teeth integrally formed with one of the strut members to extend at predetermined spaced apart intervals therealong and resiliently flexible latching arm means integrally formed with another of the strut members and having a latching head biassed by the latching arm means to snap into engagement between selected teeth during relative longitudinal sliding movement of the strut members together thereby to latch the first and the second strut members in a selected position of adjustment.

7. A device according to claim 6, wherein the latching arm means is resiliently flexible in a plane substantially parallel to the spine.

8. A device according to claim 7, wherein respective teeth have inwardly directed portions which hook over respective latching arms thereby maintaining the first and the second strut in sliding engagement.

9. A device according to claim 1, wherein the detent latching means comprises two series of latching teeth integrally formed with one strut member to extend at predetermined spaced apart intervals along respective opposite longitudinal edges thereof and two resiliently flexible latching arm means integrally formed with another strut member for flexure in a plane substantially parallel to the spine and integrally formed with respective latching heads biassed by the latching arm means to snap into engagement between selected teeth during relative longitudinal sliding movement of the strut members together thereby to latch the first and the second strut members in a selected position of adjustment.

10. A device according to claim 1, wherein one of the first and the second strut members is integrally formed with an undercut stud and another of the first and the second strut members is formed with a longitudinally extending keyhole slot which can receive the stud thereby to maintain the first and the second strut members interengage for said relative longitudinal sliding movement.

11. A device according to claim 1, wherein said end of said second strut member remote from the first strut member is bifurcated providing a pair of stiffly resilient mounting arms extending side by side in parallel relation and having free ends formed with respective trunnion mounting portions, and the first cover mounting portion comprises a pair of sockets for pivotally receiving respective trunnion mounting portions in pivotal engagement whereby the second strut member is pivotally connected to the second strut member.

12. A file cover restraining device for a loose leaf binder of the type having a pair of substantially rigid cover members hingedly joined to respective opposite, parallel, longitudinal edges of a substantially rigid spine for receiving between them stacked papers and comprising a restraining member for maintaining the cover members closed spaced apart in parallel relation and comprising a elongate strut having a first catch comprising depending hook means on one longitudinal end thereof, a first cover mounting portion pivotally connected to another, opposite end of the second strut member remote from the first end and having means for attachment to an inside surface of one cover member and, a second catch comprising eye means releasably engagable with the first catch means and having a second cover mounting portion having means for attachment to an inside surface of another cover member; so that, when the respective mounting portions are attached to respective cover members adjacent respective free edges thereof remote from the spine, the hook means and the eye means can be brought into and out of engagement by pivotal movement of the restraining member toward and away from the spine, respectively, so that when the first and second catch means are engaged, the restraining member bridges the inside surfaces of the cover members retaining them in closed condition spaced apart in parallel relation.

13. A device according to claim 12, wherein the means for attachment each comprises a layer of contact adhesive on respective cover mounting portions.

14. A device according to claim 12, wherein the means for attachment each comprises rivet means.

15. A file cover restraining device for a loose leaf binder of the type having a pair of substantially rigid, rectangular, cover members hingedly joined to respective opposite, parallel, longitudinal edges of a substantially rigid spine for receiving between them stacked papers and comprising a restraining member for maintaining the cover members closed, spaced apart in parallel relation and comprising a elongate strut having a first latching means on one longitudinal end thereof, a first cover mounting portion pivotally connected to another, opposite end thereof, remote from the first end and having means for attachment to an inside surface of one cover member and, a second latching means releasebly engagable with the first latching means and having a second cover mounting portion having means for attachment to an inside surface of another cover member; so that, when the respective mounting portions are attached to respective cover members adjacent respective free edges thereof remote from the spine, the respective latching means can be brought into and out of engagement by pivotal movement of the restraining member toward and away from the spine, respectively, so that when the first and second latching means are engaged, the restraining member bridges the inside surfaces of the cover members retaining them in closed condition spaced apart in parallel relation without protruding beyond the free edges in a direction away from the spine.

* * * * *